United States Patent [19]

Bunger, deceased

[11] Patent Number: 5,051,879

[45] Date of Patent: Sep. 24, 1991

[54] BLANK FOR ASSEMBLY INTO DECORATIVE ARTICLE

[76] Inventor: Hilary D. Bunger, deceased, late of 40 Little Fox La., Weston, Conn. 06880, by Gregory J. Bunger

[21] Appl. No.: 444,395

[22] Filed: Dec. 1, 1989

[51] Int. Cl.[5] ..... F21V 1/00

[52] U.S. Cl. ..... 362/351; 493/950

[58] Field of Search ..... 362/351, 352, 360, 361, 362/353; 493/950

[56] References Cited

U.S. PATENT DOCUMENTS

| | | | |
|---|---|---|---|
| 348,232 | 8/1886 | Myers | 362/360 |
| 476,239 | 6/1892 | Bearse | 362/360 |
| 780,875 | 1/1905 | Duncan . | |
| 863,178 | 8/1907 | Holt et al. . | |
| 867,871 | 10/1907 | Boesen | 362/360 |
| 1,310,347 | 7/1919 | Karfiol . | |
| 1,477,991 | 12/1923 | Baker | 362/360 |
| 1,537,775 | 5/1925 | Liedtke . | |
| 1,868,776 | 7/1932 | Tate | 362/360 |
| 2,067,018 | 1/1937 | Pretzfelder . | |
| 2,111,844 | 3/1938 | Davidson . | |
| 3,170,831 | 2/1965 | Paige . | |
| 4,616,293 | 10/1986 | Baliozian | 362/352 |

*Primary Examiner*—Ira S. Lazarus
*Assistant Examiner*—Sue Hagerman
*Attorney, Agent, or Firm*—Watson, Cole, Grindle & Watson

[57] ABSTRACT

A substantially flat blank of flexible plastic is provided in the shape of a major segment of a circle. Locking means is formed at opposed end portions of the segment, so that on being assembled, the blank is imitative of a lampshade.

8 Claims, 2 Drawing Sheets

BLANK FOR ASSEMBLY INTO DECORATIVE ARTICLE

The present invention refers generally to decorative articles that are adapted-for use as promotional items because they are of such low cost to manufacture that they may be packed or given away with consumer goods. More specifically, it relates to a flexible blank that may be assembled by the user into a novelty item imitative of a lampshade.

BACKGROUND OF THE INVENTION

While it is known in the art to utilize certain articles as decorations, for example, Christmas tree ornaments, such ornaments have generally been either formed from materials such that when assembled, said assembled article cannot readily be disassembled, or the article is difficult to assemble and disassemble rapidly. Moreover, the prior art has often used such novelty items in fully assembled form, so that the items are bulky and fragile, and therefore subject to being shipped only at considerable expense.

It is, therefore, a primary object of the present invention to provide a novelty item in the form of a lightweight, cut, scored and colored blank so light in weight that it is readily shipped or mailed without requiring separate packaging or protection. Such a blank is well-adapted to be assembled into a novelty item and, because of the lack of expense either in manufacture or shipment of the blank, it can be used as a premium item, to be given away in conjunction with the sale of breakfast foods or other items where the additional cost of a fraction of a cent will not significantly deplete the profit margin, but where the inclusion of a promotional item may well expand sales.

SUMMARY OF THE INVENTION

Expressed in somewhat general terms, my invention comprises a flexible blank for assembly into a decorative article. The blank includes a flat sheet formed from bendable, resilient material, such sheet being in the general shape of a major segment of a circle, which has a center and a peripheral portion extending around the circumference of the circle. Because the form is in the shape of a segment of a circle, rather than the full circle, the minor segment of the circle, which has been deleted from the blank, forms opposed end portions spaced from each other in the blank. In one form of my invention, the segment is formed with a plurality of flexible fingers that extend into a central aperture and serve to retain, e.g., a light bulb located therewithin. Locking means is provided on the opposed end portions so that when those end portions are brought into adjoining position, the flexible material bends to form a continuous, frusto-conical decorative article.

The shape of the periphery of the major segment is a feature of my invention. In one aspect thereof, the peripheral portion is formed with a plurality of cuts therein, to define tabs along the periphery of the segment. Preferably, the cuts are V-shaped with the apex of the V disposed inwardly of the periphery. The present invention also may include a score line extending generally parallel to the circumference of the blank, but inwardly thereof. When the V-shaped cuts made in the peripheral portion have their apices extending to the score line, the tabs so formed may then be bent inwardly and downwardly to occupy a position imitative of similarly extending portions of a Tiffany lamp.

Another aspect of my invention relates to the fastening means used to hold the opposed ends of the major segment together and thereby form a complete, lamp-imitative ornamental device. In a preferred embodiment, the locking means includes a flange extending from one of the opposed end portions and adapted to mate with a slot at the other of said end portions. As so mated, the flange enters the slot in the other end portion, and because of the its shape, is retained therein. More preferably, there are flanges extending from both end portions of the segment, and in assembled form, each of the flanges underlies a different part of the decorative article, thereby not only holding said article in fastened position, but strengthening the assembled article and causing it to maintain its designated shape.

These and other objects, features and advantages of the present invention will be more apparent from the detailed description of a preferred embodiment thereof as set forth hereinbelow. Such detailed description will be best understood when read in conjunction with a drawing of that preferred embodiment, in which.

DETAILED DESCRIPTION OF PREFERRED EMBODIMENT

Figure 1:
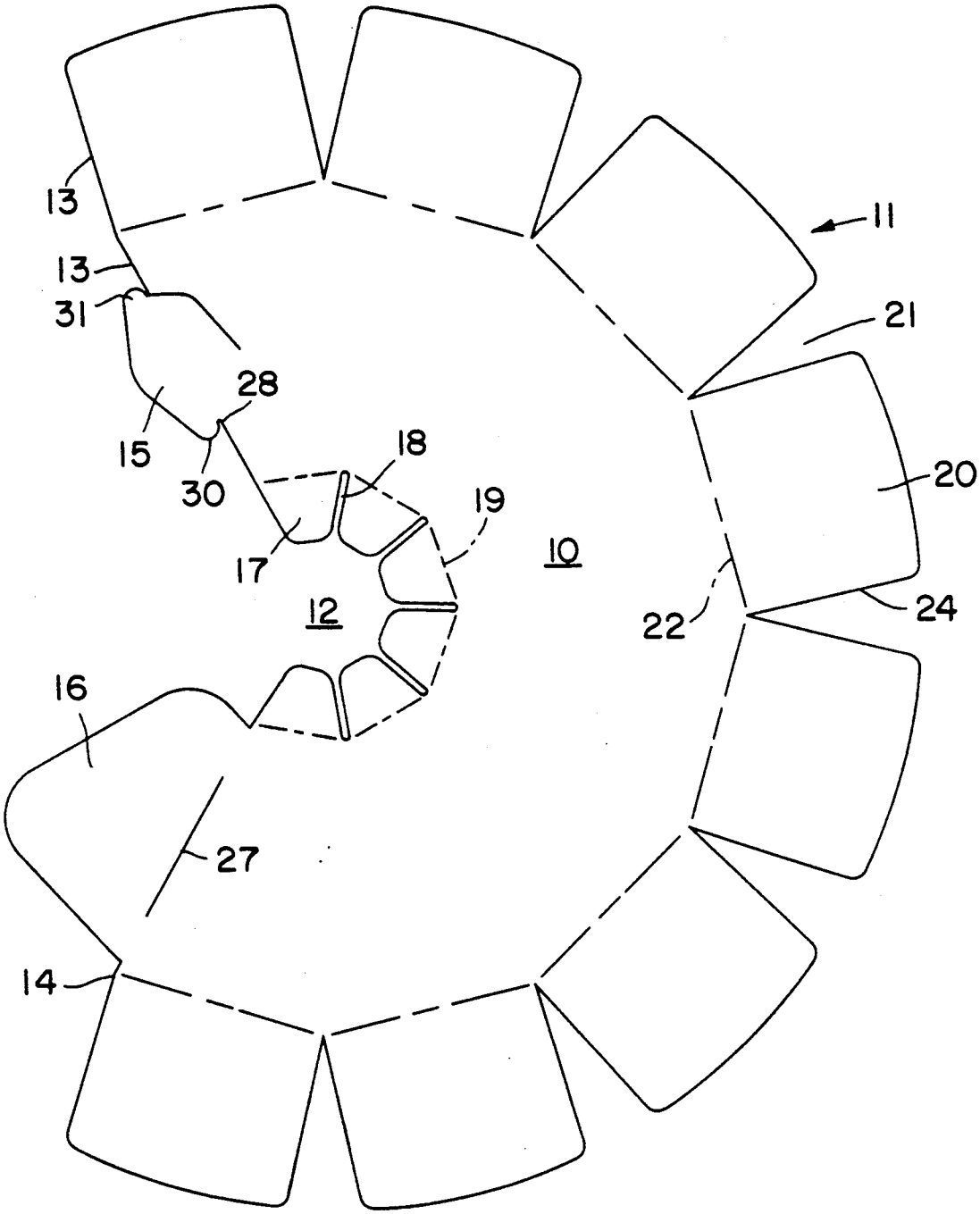
FIG. 1 is a top plan view of a blank according to the present invention.

Referring now to the drawings, and FIG. 1 in particular, a unitary blank 10 is there shown. The blank describes about 240 degrees of a circle, and constitutes a major segment thereof. The blank includes a periphery 11 and a central orifice or aperture 12, through the center of which the vertical axis of the blank extends. The periphery 11 of the blank terminates in two oppose ends 13 and 14, which ends are each provided with tabs 15 and 16, i.e., opposed end portion 13 has tab 15, the smaller of the two, extending therefrom toward opposed end portion 14. End portion 14 has larger tab 16 extending therefrom in the general direction of end portion 13 and its smaller tab 15.

With regard to the central aperture 12 of blank 10, that aperture is framed in its approximately 240° arc by a series of tabs 17 separated from each other by indentations 18, and joined by a score line 19 that extends from the base of each tab 17 to the innermost extension of indentations 18. It will be apparent from this structure that tabs 17 may be flexed along their score line 19 either upwardly or downwardly from the plane of the blank 10. That blank is suitably cut from a flexible or resilient, transparent or translucent, plastic sheet made preferably from a polymer, e.g., polyesters, polycarbonates or polystyrenes.

Now referring to the pheripheral portion 11 of the blank 10, that periphery is likewise separated into a plurality of tabs 20, which are separated from each other by V-shaped cuts 21. As will apparent from FIG. 1, the apex of the V of cut 21 extends inwardly into the body of blank 10 and terminates at score line 22. In this manner each tab 20 is free to flex along score line 22 and thus move to a position in which the side walls 24 of tabs 20 are located ajacent each other.

Figure 3:
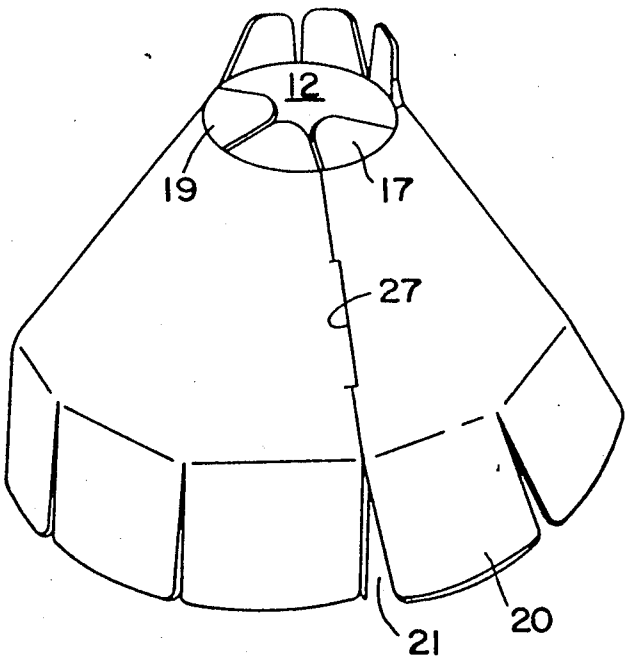
FIG. 3 is a perspective view of the article of FIGS. 1 and 2 in fully assembled position.
Figure 2:
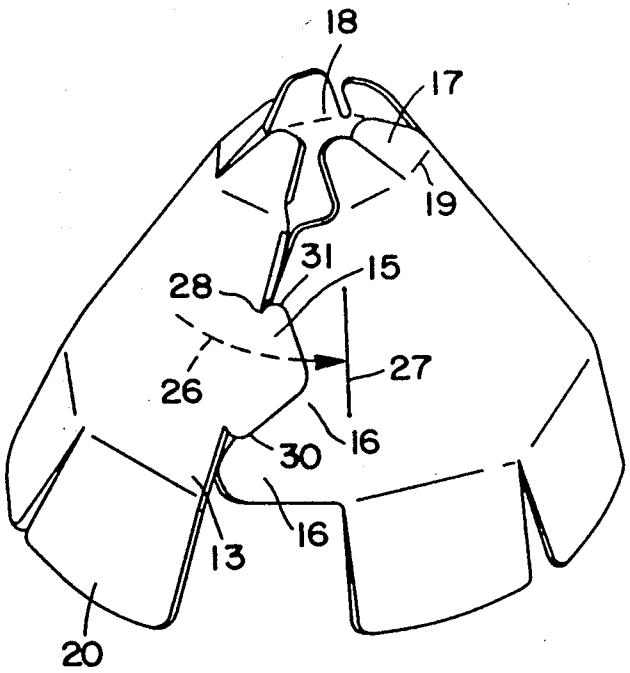
FIG. 2 is a perspective view showing the blank of FIG. 1 partially assembled.

The manner in which locking tabs 15 and 16 cooperate to hold or lock the blank in assembled position in which the blank resembles a lampshade, e.g., a Tiffany lampshade, is best seen in FIGS. 2 and 3. In FIG. 2 the blank of FIG. 1 is illustrated in the process of being assembled. In this mode of assembly, the blank is flexed so that smaller tab 15 is rotated in the direction of arrow 26 toward slot 27. It will be apparent both from FIGS. 1 and 2 that tab 15 protrudes from opposed end 13 in the form of a spatulate tongue, having grooves 28 at both ends of tab 15 where the tab constitutes an integral extension of end portion 13.

The length of the tongue or tab 15 along its greatest dimension, i.e., between the knobs 30 and 31, is somewhat greater than the length of the slot 15. So, in order to insert tab 15 within slot 27, the tab may be positioned at a slight angle so that one of the grooves or notches 28 is fitted within slot 14 and moved laterally in the slot to the depth of the notch. Once that insertion has been accomplished, the tab 15 may be pivoted so that it fits entirely within slot 27. After release of such pressure, the tab 15 and its knobs 30 and 31 will assume a position in which notches 28 are engaged by the edges of slot 27. Thus, tab 15 will be retained within slot 27, with knobs 30 and 31 overlying the ends of the slot 27 and locking the tab 15 in place.

FIG. 3 is a side elevational view showing tab 15 fully inserted within slot 27 and retained therein by the overhang of knobs 30 and 31, which extend slightly beyond the sides of slot 27. The lampshade will remain in such position until it is desired to disassemble it, in which case tab 15 may be moved e.g., upwardly in slot 14 so that the upper edge of the slot extends into a groove 28, whereupon tab 15 may be rotated until knob 30 clears the slot.

In the position of FIG. 3 it will be further apparent that larger tab 16 has now been located behind the end portion 13 of blank of major segment 10. Thus in the position shown in FIG. 3, the smaller tab 15 will be located behind end portion 14 of blank 10, and larger tab 16 will be located behind opposed end portion 13 of blank 10. In this manner not only do the tabs provide a locking function, but they lend support and rigidity to the assembled article, permitting it to be maintained in assembled position until disassembly is desired.

Further, the fingers or tabs 17 are shown in FIGS. 2 and 3 in a position in which they are bending toward each other as the material of the lampshade novelty item is flexed. As seen in FIG. 3, the fingers 17 will either continue to maintain that pendent position, or they may be flexed upwardly along score lines 19 to facilitate an electric fixture being located and maintained within the lampshade. The fact that the shade is made of a flexible or resilient material enables the tabs 17 to serve as fingers to grasp an electric fixture and maintain a light bulb, e.g., a Christmas tree bulb, within the interior space formed by the assembled blank 10.

From the above detailed description of a preferred embodiment of my invention, it will be seen that a simple blank cut from a flexible plastic resin can be utilized to form a lampshade novelty item that will be easily assembled to fit over a Christmas tree light bulb. Preferably, the lampshade will be printed with a suitable colored ink, e.g., aniline dyes, and be lined to be imitative of an lampshade. Since the blank 10 is substantially flat and, being formed from a sheet of heat-resistant plastic, is relatively inexpensive to manufacture, it can be included as a gift item without a large expenditure, thereby enhancing the attractiveness and value of the goods with which it has been included for the purpose of sale. The end result may well be a brightly colored, Tiffany style lamp that makes a fine Christmas tree ornament.

It will be apparent to those of skill in this art that certain alterations and modifications can be made in the preferred embodiment described hereinbefore without departing from the spirit of the invention. Exemplarily, the flaps 20 separated by V-shaped cuts 21 can be made continuous, and the shade simply provided with a plain or scalloped edge. As to all such alterations and modifications, it is desired that they be included within the purview of my invention, which is to be limited only by the scope, including equivalents, of the following, appended claims.

I claim:

1. A substantially flat blank for assembly into a decorative article, comprising:

a sheet formed from flexible resilient material, said sheet being in a general shape of a major segment of a circle having a center, a peripheral portion extending generally around the circumference of the circle, and opposed end portions spaced from each other where said segment is less than a full circle, said major segment also being formed with a central aperture extending from the center of the circle outwardly toward said peripheral portion, locking means formed at said opposed end portions, so that when said opposed end portions are brought into juxtaposed relationship, said flexible blank bends to form a continuous, generally frusto-conical decorative article, and a plurality of flexible fingers formed in said major segment and extending into said centrally located aperture and adapted for supportably engaging a light bulb therein.

2. A flexible blank as claimed in claim 1, in which said peripheral portion is formed with a plurality of inwardly extending cuts therein to define tabs in said peripheral portion.

3. A flexible blank as claimed in claim 2, further including a score line extending inwardly and generally parallel to the edge of said peripheral portion to define, with said cuts, tabs separated from each other and positioned about said peripheral portion.

4. A flexible blank as claimed in claim 2, in which said cuts are V-shaped with the apex of the V disposed inwardly of said peripheral portion.

5. A flexible blank as claimed in claim 3, in which said cuts are V-shaped with the apex of the V disposed inwardly of said peripheral portion.

6. A flexible blank as claimed in claim 5, in which the apex of said V terminates at said score line.

7. A substantially flat blank for assembly into a decorative article as claimed in claim 1, wherein said locking means including a firs flange extending from one of said opposed end portions and a slot formed at the other of said end portions, said slot being sized to permit entry and retention of said flange therewithin, and a second flange extending from said other end portion, and adapted to underlie and support said one end portion when said first flange is in retained position in said slot to prevent distortion of the assembled decorative article.

8. A flexible blank as claimed in claim 7, in which said first flange is in the form of a tongue having grooves at either side thereof, the length said tongue exceeding the length of said slot, so that said tongue can be inserted into and removed from said slot by a pivotal motion in which an edge of said slot is inserted into one of said grooves.

* * * * *